US009314828B2

(12) United States Patent
Grüss et al.

(10) Patent No.: US 9,314,828 B2
(45) Date of Patent: Apr. 19, 2016

(54) METHOD FOR ADJUSTING A DISCHARGE THICKNESS OF ROLLING STOCK THAT PASSES THROUGH A MULTI-STAND MILL TRAIN, CONTROL AND/OR REGULATION DEVICE AND ROLLING MILL

(75) Inventors: Ansgar Grüss, Erlangen (DE); Bernd Linzer, Linz (AT); Alois Seilinger, Linz (AT)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 1388 days.

(21) Appl. No.: 13/126,547

(22) PCT Filed: Oct. 15, 2009

(86) PCT No.: PCT/EP2009/063508

§ 371 (c)(1),
(2), (4) Date: Aug. 1, 2011

(87) PCT Pub. No.: WO2010/049280

PCT Pub. Date: May 6, 2010

(65) Prior Publication Data

US 2011/0289993 A1 Dec. 1, 2011

(30) Foreign Application Priority Data

Oct. 30, 2008 (EP) ..... 08018949

(51) Int. Cl.
*B21B 37/26* (2006.01)
*B21B 1/46* (2006.01)
*B21B 13/22* (2006.01)

(52) U.S. Cl.
CPC ..... *B21B 37/26* (2013.01); *B21B 1/463* (2013.01); *B21B 13/22* (2013.01); *B21B 2265/06* (2013.01); *B21B 2265/12* (2013.01); *B21B 2275/06* (2013.01)

(58) Field of Classification Search
CPC ..... B21B 37/24; B21B 1/463; B21B 37/26; B21B 13/22; B21B 2265/12; B22D 11/188; B22D 11/06; B22D 11/16; B22D 11/12
See application file for complete search history.

(56) References Cited

U.S. PATENT DOCUMENTS 3,946,798 A * 3/1976 Uchimoto ..... B22D 11/1282 72/237
4,335,435 A 6/1982 Miura ..... 700/149

(Continued)

FOREIGN PATENT DOCUMENTS

CN 1211476 A 3/1999 ..... B21B 37/16
CN 1760913 A 4/2006 ..... G06F 17/50

(Continued)

OTHER PUBLICATIONS

Chinese Office Action, Application No. 200980153374, 9 pages, Feb. 8, 2013.

(Continued)

*Primary Examiner* — Shelley Self
*Assistant Examiner* — Pradeep C Battula
(74) *Attorney, Agent, or Firm* — Slayden Grubert Beard PLLC

(57) ABSTRACT

In a rolling mill, an open-loop and/or closed-loop control device and a method for adjusting a discharge thickness of rolling stock which passes through a multi-stand mill train, wherein a first section of the rolling stock is rolled to a first discharge thickness, a second section of the rolling stock is rolled to a second discharge thickness which is different from the first discharge thickness. Because a transition from the first discharge thickness to the second discharge thickness takes place at a feed rate of the rolling stock into the mill train which is adjusted as a function of a discharge rate of the rolling stock of a unit which is arranged upstream of the mill train in the direction of mass flow, a method can be made available which runs essentially without reactions for units which are arranged upstream of the mill train in the direction of mass flow.

14 Claims, 2 Drawing Sheets

(56) References Cited

U.S. PATENT DOCUMENTS

| | | | | |
|---|---|---|---|---|
| 4,745,556 | A | 5/1988 | Turley | 700/149 |
| 5,307,864 | A | 5/1994 | Arvedi et al. | 164/476 |
| 5,404,738 | A | 4/1995 | Sekiguchi et al. | 72/11.4 |
| 5,904,204 | A | 5/1999 | Teraoka et al. | 164/417 |
| 6,044,895 | A * | 4/2000 | Kuttner et al. | 164/155.4 |
| 7,832,460 | B2 | 11/2010 | Arvedi | 164/455 |
| 8,020,417 | B2 | 9/2011 | Karam et al. | 72/8.6 |
| 2011/0239722 | A1 * | 10/2011 | Gruss et al. | B21B 37/46 72/324 |
| 2011/0289993 | A1 | 12/2011 | Grüss et al. | 72/7.1 |

FOREIGN PATENT DOCUMENTS

| | | | | |
|---|---|---|---|---|
| DE | 2944035 | A1 | 5/1980 | B21B 37/00 |
| DE | 3721744 | A1 | 1/1988 | B21B 37/00 |
| EP | 0415987 | A1 | 3/1991 | B21B 1/46 |
| EP | 0730916 | A1 | 9/1996 | B21B 37/26 |
| EP | 1868748 | A1 | 12/2007 | B21B 1/46 |
| JP | 59191509 | A | 10/1984 | B21B 37/00 |
| JP | 60148620 | A | 8/1985 | B21B 37/24 |
| JP | 61273210 | A | 12/1986 | B21B 37/00 |
| JP | 0615317 | A | 1/1994 | B21B 37/00 |
| JP | 8300010 | A | 11/1996 | B21B 15/00 |
| JP | 08300010 | A | 11/1996 | B21B 15/00 |
| JP | 0929395 | A | 2/1997 | B21B 1/46 |
| JP | 10192936 | A | 7/1998 | B21B 37/00 |
| JP | 10232848 | A | 9/1998 | G06F 13/00 |
| JP | 2001293510 | A | 10/2001 | B21B 37/00 |
| JP | 2004283909 | A | 10/2004 | B21B 1/26 |
| JP | 2005238271 | A | 9/2005 | B21B 37/00 |
| JP | 2007061850 | A | 3/2007 | B21B 37/00 |
| SU | 865460 | A1 | 9/1981 | B21B 37/72 |
| WO | 2006/136670 | A1 | 12/2006 | B21B 37/16 |
| WO | 2010/049280 | A2 | 5/2010 | B21B 37/26 |

OTHER PUBLICATIONS

Spitzer, Karl-Heinz et al., "Entwicklungsstand beim DSC-Bandgiessverfahren," Stahl and Eisen, Bd. 121, No. 5, 9 pages, May 16, 2001.

Turowski, Bill et al., "Flying Gage Change Technology for Hot Strip Mills," Prospekt, 4 pages, Mar. 2, 2006.

EP Office Action, EP Patent Application No. 08018949.1-2302, 9 pages, Feb. 16, 2009.

International PCT Search Report, PCT/EP2009/063508, 13 pages, Mailed May 11, 2010.

Japanese Office Action, Application No. 2011-533668, 6 pages, Jul. 23, 2013

* cited by examiner

METHOD FOR ADJUSTING A DISCHARGE THICKNESS OF ROLLING STOCK THAT PASSES THROUGH A MULTI-STAND MILL TRAIN, CONTROL AND/OR REGULATION DEVICE AND ROLLING MILL

CROSS-REFERENCE TO RELATED APPLICATIONS

This application is a U.S. National Stage Application of International Application No. PCT/EP2009/063508 filed Oct. 15, 2009, which designates the United States of America, and claims priority to EP Application No. 08018949.1 filed Oct. 30, 2008. The contents of which are hereby incorporated by reference in their entirety.

TECHNICAL FIELD

The invention relates to a method for adjusting a discharge thickness of rolling stock, in particular a hot strip, which passes through a multi-stand mill train, wherein a first section of the rolling stock is rolled to a first discharge thickness, and wherein a second section of the rolling stock is rolled to a second discharge thickness which is different from the first discharge thickness. Furthermore, the invention relates to an open-loop and/or closed-loop control device for a rolling mill which includes a multi-stand mill train. In addition, the invention relates to a rolling mill having a multi-stand mill train for rolling metallic rolling stock.

The present invention relates to the technical field of rolling plant technology. The rolling of metallic stock generally serves to manufacture semi-finished products which are subsequently used in the metal-processing industry, for example in the automobile industry.

BACKGROUND

A rolling mill must generally be able to manufacture a wide variety of metallic semi-finished products which differ, for example, in the metal to be processed, in the joining properties of steel to be processed and the spatial dimensions, in particular the thickness.

In this respect it is necessary for operation of a rolling mill to be able to be reset in such a way that strips with very different properties can be fabricated in as rapid a succession as possible so that a high equipment throughput rate is achieved. This is necessary both for hot rolling and for cold rolling. The prior art discloses methods which permit such resetting of the properties of produced strips by means of a rolling mill.

Japanese Laid-Open Application JP 2001293510 A2 discloses a method for controlling a flying change in thickness of a continuously operating hot strip train. A method is disclosed with which the automatic change in thickness can be determined per rolling stand.

Japanese Laid-Open Application JP 59191509 A2 discloses a method for changing material dimensions during the passage of rolling stock in a continuously operating mill train. In this context, manipulated variables are calculated from an initial state and position tracking for the section of the strip whose thickness is to be changed is carried out. Accordingly, a rolling gap and a rolling speed for the respective rolling mill are set. In particular there is provision for no reduction in thickness to take place any more at the last rolling stand.

SUMMARY

According to various embodiments, an improved method for carrying out a flying change in thickness and a corresponding open-loop and/or closed-loop control device and rolling mill for this purpose can be made available.

According to an embodiment, in a method for adjusting a discharge thickness of rolling stock, in particular a hot strip, which passes through a multi-stand mill train, wherein a first section of the rolling stock is rolled to a first discharge thickness, and wherein a second section of the rolling stock is rolled to a second discharge thickness which is different from the first discharge thickness, a transition from the first discharge thickness to the second discharge thickness, which takes place during the rolling, takes place at a feed rate of the rolling stock into the mill train which is adjusted as a function of a discharge rate of the rolling stock of a unit which is arranged upstream of the mill train in the direction of mass flow.

According to a further embodiment, the feed rate can be adjusted essentially to the discharge rate of a subsequent unit which is arranged upstream of the mill train. According to a further embodiment, the mill train and at least one unit, preferably a casting unit, which is arranged upstream of the mill train in the direction of mass flow can be coupled in terms of fabrication technology by the rolling stock having the first and the second rolling stock sections. According to a further embodiment, a first pass sequence and a second pass sequence can be predefined, wherein when the first pass sequence is carried out the first discharge thickness is rolled, and when the second pass sequence is carried out the second discharge thickness is rolled, wherein there is a transition from operation of the mill train according to the first pass sequence during the rolling of rolling stock into operation of the mill train according to the second pass sequence, wherein the transition for each rolling stand of the mill train takes place essentially during the rolling of a defined transition section of the rolling stock by the respective rolling stand. According to a further embodiment, the transition section can be determined in such a way that at every point in time during its passage through the mill train it has a length which is at maximum equal to a distance between two adjacent rolling stands. According to a further embodiment, the transition section can be rolled by means of a plurality of rolling stands which are included in the mill train, wherein at least one rolling stand is operated as a rolling stand with regulated rolling force during the rolling of the transition section. According to a further embodiment, during the rolling of the transition section, an actual process variable which is adjusted on the basis of the first pass sequence can be continuously changed into a setpoint process variable which is determined on the basis of the second pass sequence. According to a further embodiment, during the rolling of the transition section, compliance with technical plant restrictions can be checked and if the restrictions are infringed or are expected to be infringed, the transition from the operation of the mill train according to the first pass sequence to the operation of the mill train according to the second pass sequence is interrupted. According to a further embodiment, the rolling force and/or the rolling gap of a rolling stand which is to be passed through next by the transition section can be adjusted, in addition to the first and second pass sequences, as a function of the strip tension between this rolling stand and the rolling stand which is arranged upstream of this rolling stand in the direction of mass flow. According to a further embodiment, during the transition from the operation of the mill train according to the first pass sequence to the operation of the mill train according to the second pass sequence, each rolling stand of the mill train can be operated in such a way that the relative change from the first discharge thickness to the second discharge thickness for each rolling stand of the mill train is essentially constant. According to a further embodiment, after the transition from the operation of the mill train according to the first pass sequence to operation of the mill train according to the second pass sequence, drive loads of rolling stand drives which are assigned to the mill train can be redistributed during the rolling of the second discharge thickness. According to a further embodiment, a change, necessary due to the changed discharge thickness of the mill train, in manipulated variables for at least one unit which is arranged downstream of the mill train in the direction of mass flow may take place while the transition section is being influenced by this at least one unit.

According to another embodiment, an open-loop and/or closed-loop control device for a rolling mill which includes a multi-stand mill train, having a machine-readable program code which has control commands which, when executed, cause the open-loop and/or closed-loop control device to carry out the method as described above.

According to yet another embodiment, a rolling mill may have a multi-stand mill train for rolling metallic rolling stock, having an open-loop and/or closed-loop control device as described above, having a device for feeding the discharge rate of the rolling stock of a unit which is arranged upstream of the mill train in the direction of mass flow to the open-loop and/or closed-loop control device, wherein the rolling stands of the mill train are operatively connected to the open-loop and/or closed-loop control device.

BRIEF DESCRIPTION OF THE DRAWINGS

Further advantages of the invention emerge from an exemplary embodiment which will be explained in more detail below with reference to the schematic drawing, in which.

DETAILED DESCRIPTION

Figure 1:
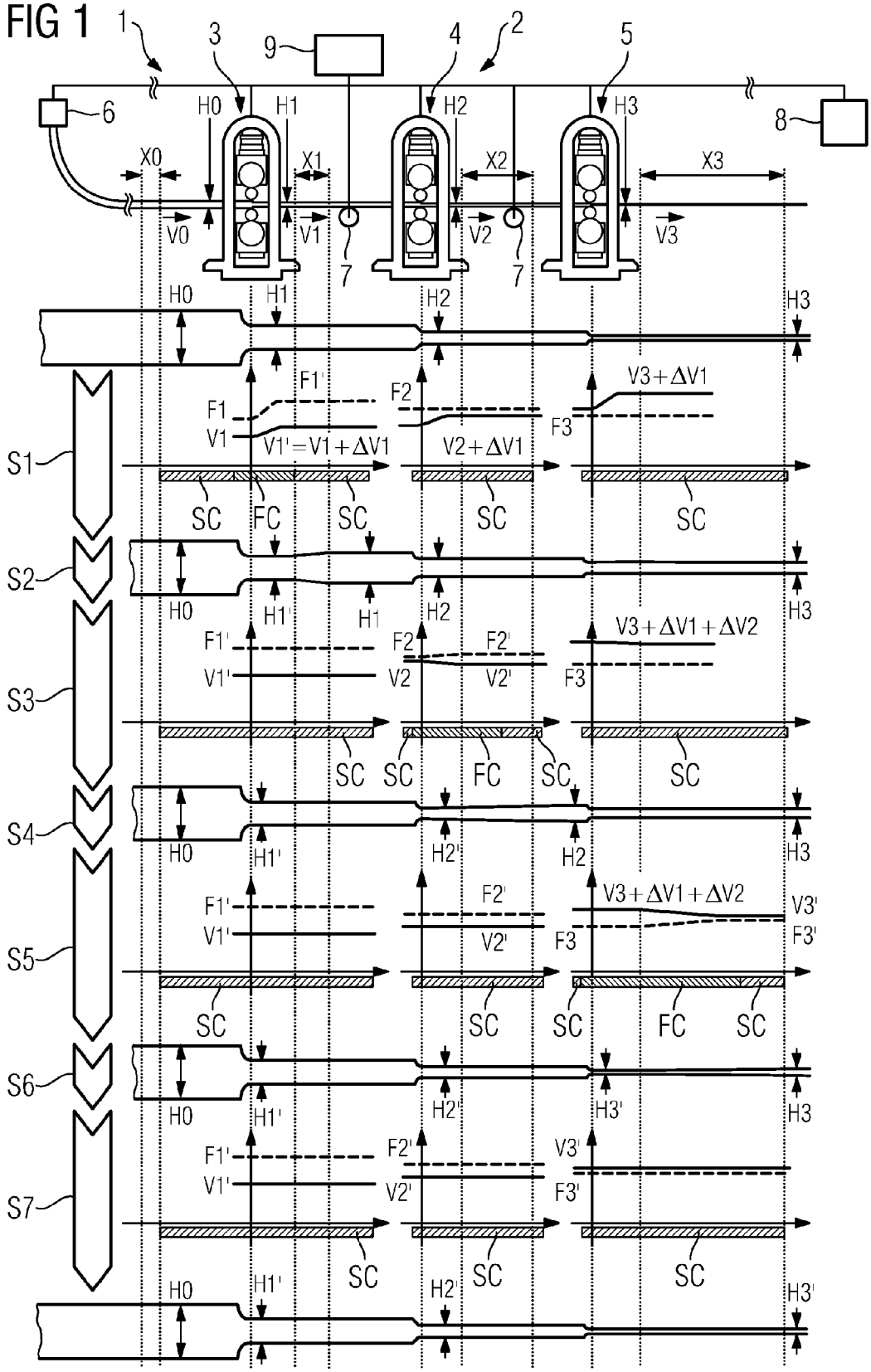
FIG. 1 shows a schematically illustrated plant for carrying out an embodiment of the method, wherein a unit which casts metal is embodied as an ingot mold.

According to various embodiments, in a method of the type mentioned at the beginning, a transition from the first discharge thickness to the second discharge thickness, which takes place during the rolling, takes place at a feed rate of the rolling stock into the mill train which is adjusted as a function of a discharge rate of the rolling stock of a unit which is arranged upstream of the mill train in the direction of mass flow.

Such a transition of the rolling stock from the first discharge thickness to the second discharge thickness during the rolling of the rolling stock is also referred to below as a flying change or changeover of the discharge thickness.

The feed rate which is determined serves as a fixed input value, which cannot be adapted as desired, for the mill train, which is in particular not changed by processes downstream of the first rolling stand of the mill train in the direction of mass flow. Instead, the feed rate of the rolling stock into the mill train is dependent on a discharge rate of the rolling stock of one or more units which are arranged exclusively upstream of the mill train in the direction of mass flow.

An actual discharge rate of the rolling stock of a unit which is arranged upstream of the mill train in the direction of mass flow is preferably used as the discharge rate. Alternatively, a setpoint discharge rate of the rolling stock of a unit which is arranged upstream of the mill train in the direction of mass flow can be used. The discharge rate of that unit of the rolling mill which has the lowest chronological dynamics and therefore reacts with greater inertia than the other units when changes occur to the process thereof is preferably used. This unit represents the limitation during the flying changeover of the discharge thickness. Further limitations for the flying changeovers of the discharge thickness may result from the necessary or possible adjustment travel on the rolling stands and the necessary or possible acceleration of the working rollers of the rolling stands in the mill train.

Discharge thickness is understood to be the thickness of the rolling stock after the last rolling stand of the mill train, and feed thickness is understood to be the thickness of the rolling stock before the first rolling stand of the mill train. The method is suitable both for changing a relatively thin discharge thickness into a relatively thick discharge thickness and vice versa. However, as a rule the changing of the discharge thickness to a thinner discharge thickness is technically more demanding than the changing over of a relatively thin discharge thickness into a thicker discharge thickness.

A unit is a device in a rolling mill which machines, processes or generates rolling stock and which is indirectly or directly operatively connected to the mill train. Examples of this are, for example, a coiler, furnace, rolling stand, casting machine, trimmer, descaler, cooling section etc.

In previous methods for carrying out a flying change in thickness in a mill train, the feed rate is generally a variable manipulated value with which a reaction is brought about, for example, to fluctuations in mass flow or in strip tension in the mill train, caused by the resetting of the operation of the mill train, by changing this actual manipulated value. The deviations in process variables, for example the mass flow, which are caused by the transition can therefore be corrected.

However, the change in the feed rate is, under certain circumstances, propagated to the units of the mill train which are arranged upstream in the direction of mass flow. Depending on the design of the rolling mill, this can lead to considerable problems in the process control of the processes occurring at the units which are arranged upstream of the mill train in the direction of mass flow.

However, this can be avoided by means of the various embodiments by determining, setting and maintaining the feed rate of the rolling stock into the mill train in such a way that adaptation of a rolling stock discharge rate of a unit arranged upstream in the direction of mass flow to the feed rate of the mill train is not necessary, or is necessary only to a relatively small degree. In particular, the units which are arranged upstream of the mill train in the direction of mass flow can be operated according to their setpoint values without a correction of the setpoint values due to processes which are arranged downstream in the direction of mass flow, in particular due to a transition of rolling stock from a first discharge thickness to a second discharge thickness, being necessary.

In other words, the mass flow turbulences in the mill train which are caused by the transition can be cascaded out completely in the direction of mass flow according to various embodiments. That is to say cascading out counter to the direction of mass flow—as is customary today—is not absolutely necessary by virtue of the fact that the feed rate is either increased—for example by changing from a first discharge thickness to a larger second discharge thickness—or is reduced—for example by changing the first discharge thickness to a smaller, second discharge thickness. The feed rate, which is adjusted as a function of a discharge rate of the rolling stock of a unit which is arranged upstream of the mill train in the direction of mass flow, can be handled according to various embodiments as a hard peripheral condition which is to be complied with in the rolling process.

However, it is also possible to use mixed cascading out of fluctuations in the mass flow in the mill train during the transition in the direction of mass flow and counter to the direction of mass flow. For example, the feed rate of the rolling stock into the mill train is only changed during the transition in a reactive way to the processes which are arranged upstream in the direction of mass flow such that said processes can still follow the change in the feed rate into the mill trains sufficiently quickly in terms of control technology, i.e. there is no process disruption of the units arranged upstream in the mill train in the direction of mass flow. For this purpose, in addition to the discharge rate, the chronological dynamics of the unit are taken into account, i.e. how quickly and to what extent this unit can react to changes in the process without process disruption occurring. Necessary corrections in the mass flow above and beyond this are then cascaded out in the direction of mass flow. This has the advantage that, in particular in the case of a reduction in the discharge thickness, the actuator elements in the rear rolling stands are stressed less in the case of mixed forward cascading out and rearward cascading out, since the reduced feed rate of the rolling stock into the mill train also lowers the rolling rate of the rolling stock at the rear rolling stands of the mill train.

The various embodiments can be applied both to hot rolling and cold rolling of metal strips.

In particular it is advantageous during the flying changing of the discharge thickness according to various embodiments to switch off the automatic gauge control (AGC) temporarily for a respective rolling stand of the mill train in order to avoid incorrect control interventions during the transition of the rolling stock.

It is also advantageous that the feed rate is adjusted essentially constantly as a function of a discharge rate of the rolling stock of a unit which is arranged upstream of the mill train in the direction of mass flow. In this way, advantages according to various embodiments can also be obtained in particular for slowly changing processes which are arranged upstream of the mill train. This is particularly advantageous in the case of casting rolling plants since the casting rate is generally constant and the casting unit is generally the unit with the smallest chronological dynamics.

In particular, the various embodiments permit a constant mass flow into the rolling mill to be ensured at the input side. This leads to corresponding planning security and smoother sequencing of the processes which are arranged upstream of the mill train in the direction of mass flow.

In one embodiment, the feed rate is adjusted essentially to the discharge rate of a subsequent unit which is arranged upstream of the mill train. This is expedient in particular when, for example in the case of batch rolling, the distance between the rolled slabs and the slabs to be rolled is very small. This is also advantageous, for example, in the continuous operating mode, the "conti" operating mode or in the "semi-endless" operating mode of a rolling mill. As a result, the process control which is undisrupted by the feed rate of the mill train is possible in the units which are arranged upstream of the mill train in the direction of mass flow, in particular there are no deviations from the desired strip tension or the desired mass flow.

In a further embodiment, the mill train and at least one unit, preferably a casting unit, which is arranged upstream of the mill train in the direction of mass flow, are coupled in terms of fabrication technology by the rolling stock having the first and the second rolling stock sections. That is to say a change in the feed rate into the mill train, which is not caused by the unit arranged upstream, is propagated via the rolling stock into the units which are arranged upstream of the mill train in the direction of mass flow and therefore disadvantageously influences the processes occurring in these units. In particular it is possible that units which are arranged upstream of the mill train in the direction of mass flow are not capable of reacting to the relatively fast changes in the feed rate, such as are customary and also necessary in the prior art, in order to compensate for fluctuations in the mass flow during the transition. As a result, incorrect processing of rolling stock may occur in at least one of the units arranged upstream of the mill train in the direction of mass flow if said unit cannot sufficiently quickly follow the changes in the feed rate. This is significant in particular for casting rolling plants in which, for example such as in the case of the endless strip production plant from Arvedi, the rolling stock extends from a casting machine through the entire rolling mill, in particular through the mill train, to a coiler. The completely rolled metal strip is then wound up there.

In terms of the chronological dynamics of the unit, the casting plant is here the "weakest" element in the chain with respect to control technology. The manipulated values which can be set during the casting generally cannot influence the casting processes as quickly as changes in the feed rate of the mill train. That is to say undesired casting faults occur. This also applies similarly to other units which are arranged upstream of the mill train in the direction of mass flow. This can all be avoided by this embodiment.

In a further embodiment, a first pass sequence and a second pass sequence are predefined, wherein when the first pass sequence is carried out the first discharge thickness is rolled, and when the second pass sequence is carried out the second discharge thickness is rolled, wherein there is a transition from operation of the mill train according to the first pass sequence during the rolling of rolling stock into operation of the mill train according to the second pass sequence, wherein the transition for each rolling stand of the mill train takes place essentially during the rolling of a defined transition section of the rolling stock by the respective rolling stand. This makes it possible to keep the consumption of rolling stock for the flying changing of the discharge thickness as low as possible since only the transition section is discarded and not the entire length of the mill train, for example in the case of simultaneous transition of the rolling stands from the operation according to the first pass sequence into the operation according to the second pass sequence. Accordingly, the amount of rolling stock which is discharged is reduced. In particular, this method can be advantageously used in "conti" operating mode of a mill train. This is because there is just a single transition section here which can be assigned to a flying change of the discharge thickness of the mill train, while in the "batch" operating mode, cutting losses of rolling stock always additionally also occur.

In one embodiment, the transition section is determined in such a way that at every point in time during its passage through the mill train it has a length which is at maximum equal to a distance between two adjacent rolling stands. This ensures that the flying changeover of the discharge thickness of the mill train takes place in a way which is technically particularly simple and fast. If, in fact, the thickness wedge is located simultaneously in two rolling stands, this means considerable additional expenditure on the control of the flying changeover of the discharge thickness. It is therefore advantageous to determine the length of a transition section in such a way that at any specific time during the transition the thickness wedge is only ever machined in one rolling stand of the mill train. This condition is generally met if the length of the transition section between the last and the penultimate rolling stand in the direction of mass flow in the rolling train which brings about a change in thickness of the rolling stock is not greater than a distance between these two rolling stands from one another. The length of the transition section which is to be determined is dependent on the number of rolling stands in the mill train and the feed thickness of the rolling stock into the mill train and the desired discharge thickness of the rolling stock from the mill train.

In a further embodiment, the transition section is rolled by means of a plurality of rolling stands which are included in the mill train, wherein at least one rolling stand is operated as a rolling stand with regulated rolling force during the rolling of the transition section. This is advantageous in particular since for rolling stands which are arranged increasingly close to the end of the mill train, tracking the strip leads, under certain circumstances, to values which are too imprecise with regard to the position of the thickness wedge or the transition section in the mill train since the speed of the rolling stock in this area of the mill train is already comparatively high. Accordingly, setting the rolling gap with any regulated position in order to machine the transition section in a desired way, in particular through the last rolling stands of the mill train, is technically difficult. If, on the other hand, a rolling stand with regulated rolling force is used to roll the transition section in accordance with the specifications, the thickness wedge is automatically detected since when the transition section enters the rolling gap of the rolling stand a change in rolling force occurs as a result of the changed thickness of the thickness wedge. The change in the rolling force and the respective rolling stand is dependent on whether the feed thickness into the respective rolling stand is smaller or greater as a result of the transition. Before and after the rolling of the transition section by the respective rolling stands, said rolling stands are preferably operated with regulated position.

Given a reduced feed thickness of the transition section compared to the preceding rolling stock section which is machined by this rolling stand, a drop in the rolling force occurs at this rolling stand when the transition section enters the rolling gap of said rolling stand. The rolling force controller then attempts to set the desired setpoint rolling force again in accordance with the first pass sequence for this rolling stand. However, the setpoint rolling force which is to be set is preferably simultaneously continuously changed in the direction of the setpoint value of the rolling force in accordance with the second pass sequence. There is then what is referred to as a "ramp in" of the setpoint rolling force of the second pass sequence into the setpoint rolling force of the first pass sequence. This "ramp in" leads to a situation in which, during the discharge of the transition section out of the respective rolling stand, the corresponding manipulated values are then set in accordance with the second pass sequence and the discharge thickness out of the respective rolling stand which is desired according to the second pass sequence is achieved. This is done for each rolling stand of the mill train.

A transition of the operating mode of the rolling stand according to the first pass sequence into a second pass sequence is handled similarly, in which transition the first discharge thickness out of the mill train is lower than the second discharge thickness. In this case, for example an increased reduction in thickness does not occur in the first rolling stand of the mill train but rather a smaller reduction in thickness occurs compared to the rolling in accordance with the first pass sequence.

As a result, an increase in rolling force occurs when the transition section which is machined by the first rolling stand is fed into the second rolling stand and, if appropriate, the subsequent rolling stands. This increase in rolling force can be used to detect the feeding of the transition section into the respective rolling stand. In a manner similar to the statements above, what is referred to as a "ramp in" of the setpoint value of the rolling force according to the second pass sequence into the setpoint value of the rolling force according to the first pass sequence occurs during the rolling of the transition section by the respective rolling stand. The use of at least one rolling stand with regulated rolling force provides a simple possibility of carrying out a flying changeover of the discharge thickness without a relatively large amount of expenditure, in particular with regard to tracking the position of the transition section and a rolling gap with regulated position.

In a further embodiment, during the rolling of the transition section, an actual process variable which is adjusted on the basis of the first pass sequence is continuously changed into a setpoint process variable which is determined on the basis of the second pass sequence. This avoids a sudden change in process variables during the rolling of the transition section. Examples of process variables which experience a continuous change during the rolling of the transition section are, for example: adjustment position, adjustment force, circumferential speed of the working rollers, acceleration rate, etc. This is advantageous in particular for the abovementioned changing of the rolling force during the rolling of the transition section. A continuous transition, i.e. changing of the process variables without jumps or jolts, simplifies the handling of the rolling stock for units which are arranged downstream of the mill train in the direction of mass flow and reduces the loading on the plant. This may be achieved, for example, with the "ramp in", described above, of a second setpoint variable into a first setpoint variable. A superimposition of the setpoint variables is performed in such a way that a continuous change takes place from the actual process variable in the direction of the new setpoint process variable.

In a further embodiment, during the rolling of the transition section, compliance with technical plant restrictions is checked and if the restrictions are infringed or are expected to be infringed, the transition from the operation of the mill train according to the first pass sequence to the operation of the mill train according to the second pass sequence is interrupted. Technical plant restrictions are understood to be restrictive peripheral conditions which are predefined via the plant, in particular of a technical nature, which have to be complied with so that a plant can be operated according to schedule over a relatively long time and a desired product can be fabricated. Examples of technical plant restrictions are, for example, maximum adjustment speeds of the rolling stands, maximum permissible drive loads, etc. The checking of the technical plant restrictions which is preferably carried out continuously during operation of the plant ensures that overloads which occur, under certain circumstances, as a result of the rolling of the transition section do not lead to a plant defect and therefore to plant downtimes.

As a result of the interruption of the transition, it is accepted, for the sake of plant safety, that more discarded rolling stock will be rolled than anticipated in order to avoid damage to the plant or individual plant components. Specifically, the drives on the rolling stands may be overloaded, for example, in the case of a flying changeover of the discharge thickness from a first relatively large discharge thickness to a second smaller discharge thickness.

If the overloading during the rolling of the transition section is too large, one or more drives may be damaged or fail. Since this would lead to a relatively long downtime of the mill train and therefore of the rolling plant, this should be avoided as far as possible. Interruption of the transition is understood to be any directed deviation from the scheduled implementation, advantageously this is generally the fastest possible implementation, of the transition. In particular, slowed-down execution of the transition may also be considered to be an interruption in the scheduled transition. As a result, gradients during the setting of manipulated variables and process variables can be reduced, as a result of which, under certain circumstances, plant restrictions can be complied with.

In a further embodiment, the rolling force and/or the rolling gap of a rolling stand which is to be passed through next by the transition section is adjusted, in addition to the first and second pass sequences, as a function of the strip tension between this rolling stand and the rolling stand which is arranged upstream of this rolling stand in the direction of mass flow. Owing to the flying changing of the discharge thickness in the mill train, excessive tension may occur in the strip or the strip tension may be lost between the rolling stands depending on the type of transition, i.e. from a relatively small discharge thickness to a larger discharge thickness or from a relatively large discharge thickness to a smaller discharge thickness. This excessive tension or loss of tension may be caused by mass flow turbulences between the rolling stands of the mill train. Strip tension may be detected, for example, by means of a loop lifter between the individual rolling stands of the mill train. The adjustment of the rolling stand which is the next to be passed through by the transition section is then changed on the basis of the detected strip tension or the deflection of the loop lifter. The change of the adjustment can have the objective of setting the rolling gap or of setting a desired rolling force for the rolling stock. If, for example, a drop in tension is detected, for example the rolling gap of the rolling stand which is the next to be passed through by the transition section is opened in order to restore the strip tension, since as a result more material can be transported through the next rolling stand. When the strip tension is too high, the adjustment is similarly closed in order to reduce the strip tension between the rolling stand which is the next to be passed through by the transition section and the rolling stand which is arranged upstream of the this rolling stand in the direction of mass flow. This ensures that a desired strip tension between the individual rolling stands of the mill train is maintained even during flying changing of the discharge thickness. However, during the corresponding changes of the rolling gap it is necessary to ensure that the thickness tolerances of the product to be manufactured are complied with.

In a further embodiment, during the transition from the operation of the mill train according to the first pass sequence to the operation of the mill train according to the second pass sequence, each rolling stand of the mill train is operated in such a way that each rolling stand produces the same relative change in the thickness of the rolling stock. A relative change in the thickness of the rolling stock is understood here to be a measure of the ratio of the discharge thickness of the respective rolling stand according to the first pass sequence and according to the second pass sequence.

This permits the respective drives of the rolling stands to be speeded up uniformly during the transition of the operation of the mill train according to the first pass sequence into the operation of the mill train according to the second pass sequence. If the change in thickness is initiated by the adjustment of a first rolling stand with simultaneous acceleration or deceleration of the following shaping steps with the corresponding increase in the discharge rate from the first adjusted rolling stand of the mill train and also the relative change in the discharge thickness for the respective rolling stand is also adopted in the following rolling stands of the mill train, the entire mill train can therefore be reset to the second discharge thickness of the mill train with little effort. Since each rolling stand brings about the same relative change in the thickness of the rolling stock during the rolling of the transition section, the drives of the entire mill train only need to be accelerated or decelerated at the respective first change in the adjustment of the respective rolling stands.

In particular it is advantageous, after the transition from the operation of the mill train according to the first pass sequence to operation of the mill train according to the second pass sequence, to redistribute drive loads of rolling stand drives which are assigned to the mill train, during the rolling of the second discharge thickness. The second pass sequence is in fact under certain circumstances not optimized for steady-state operation of the mill train for the production of the second discharge thickness but is instead optimized for execution of the transition of the first discharge thickness to the second discharge thickness as easily as possible. For this reason, redistribution of the drive loads after the transition has taken place can lead to a permanent reduction in the drive loads, which increases the operational reliability. Those drives which drive the working rollers of the respective rolling stands of the mill train are referred to as rolling stand drives.

In a further embodiment, a change, necessary due to the changed discharge thickness of the mill train, in manipulated variables for at least one unit which is arranged downstream of the mill train in the direction of mass flow takes place while the transition section is being influenced by this at least one unit. This ensures that the units which are arranged downstream of the mill train in the direction of mass flow also use the transition section in which the first discharge thickness changes into the second discharge thickness, in order to change their manipulated values. For example, the flow of coolant in the cooling section can be correspondingly adapted to the new discharge thickness from the mill train. Likewise, for example the torque and/or the rotational speed of the coiler can be adapted to the new discharge thickness from the mill train. This adaptation of the respective manipulated values is preferably carried out when the actual transition section of the rolling stock is influenced by changing this manipulated value.

According to another embodiment, an open-loop and/or closed-loop control device for a rolling mill may include a multi-stand mill train, having a machine-readable program code which has control commands which, when executed, cause the open-loop and/or closed-loop control device to carry out a method as described above.

According to yet another embodiment, a rolling mill may have a multi-stand mill train for rolling metallic rolling stock, an open-loop and/or closed-loop control device as described above, having a device for feeding the discharge rate of the rolling stock of a unit which is arranged upstream of the mill train in the direction of mass flow to the open-loop and/or closed-loop control device, wherein the rolling stands of the mill train are operatively connected to the open-loop and/or closed-loop control device. In this way, a rolling mill is made available by means of which a flying change of the discharge thickness of a mill train can easily be implemented. A rolling mill is understood here to be any plant which comprises a mill train, preferably for processing metallic rolling stock, in particular also casting rolling plant.

In a further embodiment of the rolling mill, the mill train is a high reduction mill which is arranged downstream of a casting unit in the direction of mass flow and/or a fabrication train. A high reduction mill is a mill train which is composed in the present case of a plurality of stands and which rolls the rolling stock with a large reduction in thickness while said rolling stock is still very hot. It is possible to differentiate between liquid core reduction and soft core reduction. As a rule, liquid core reduction is not applied in a high reduction mill but soft core reduction of the rolling stock certainly is. In the case of soft core reduction, the core of the rolling stock is already solid but still very soft owing to the high temperature of, for example, 1200° C. to 1300° C. If the rolling stock was still to have a liquid core in the high reduction mill, considerable process disruption would be expected as result of the large forces in the high reduction mill. Large decreases in thickness of the rolling stock can be achieved by the high reduction mill with soft core reduction with comparatively small rolling forces. The method according to various embodiments can be advantageously applied for such a multi-stand high reduction mill. Furthermore, the mill train can alternatively or additionally be embodied as a multi-stand fabrication train which rolls rolling stock to desired final dimensions.

FIG. 1 shows a schematically illustrated plant for implementing an embodiment of the method. In addition, said figure shows thickness profiles of rolling stock which is rolled by the milltrain during the transition of the mill train operation according to a first pass sequence to mill train operation according to a second pass sequence for different degrees of progression of the transition states of the rolling stock. Furthermore, FIG. 1 shows the rolling force and circumferential speed profiles as a function of the time for the individual rolling stands of the mill train.

FIG. 1 shows a detail of a rolling mill 1, which comprises a three-stand mill train 2. The mill train 2 can be embodied, for example, as a high reduction mill for a plant for endless strip production. The mill train 2 can alternatively or additionally be embodied as a multi-stand, for example five-stand, fabrication train of a rolling mill 1. In the present case, the mill train 2 comprises a first rolling stand 3, a second rolling stand 4 and a third rolling stand 5.

FIG. 1 shows the rolling mill 1 in a state in which rolling stock G passes through the rolling mill 1, in particular the mill train 2. In the exemplary embodiment, the entire rolling mill is coupled by the rolling stock G which passes through the rolling mill, since the construction is in one part from the start to the end of the rolling mill 1, and different sections of the rolling stock G are respectively located in other units of the rolling mill 1 in order to be processed. Basically, the various embodiments can be used particularly advantageously for this operating mode, i.e. for the "continuous process". However, this invention is not restricted to this operating mode.

According to a first pass sequence, the mill train 2 rolls a first section G-1 of the rolling stock to a first discharge thickness H3 of the mill train 2.

If the discharge thickness is then to change, without, for example, providing a break in the casting for this purpose, this can be done with the various embodiments during the rolling of the rolling stock G which couples the plant.

In the exemplary embodiment, the discharge thickness from the mill train 2 will be changed from a first discharge thickness H3 for a first section G-1 of the rolling stock G to a second, relatively thin discharge thickness H3' for a second section G-2 of the rolling stock G.

Loop lifters 7, in particular for a mill train 2 which is embodied as a fabrication train, are respectively arranged in the mill train 2 of the rolling mill 1, in particular between the rolling stand 3 and the rolling stand 4, or respectively between the rolling stand 4 and the rolling stand 5. Said loop lifters 7 serve to check the strip tension of the rolling stock G which passes through the mill train 2.

FIG. 1 also shows a unit 6 which is arranged upstream of the mill train 2 in the direction of mass flow and which is embodied as a casting unit for casting steel.

In addition, FIG. 1 also shows a unit 8 which is arranged downstream of the mill train in the direction of mass flow and which is embodied, for example, as a cooling section. In the steady-state operating mode, the rolling stock G which is cast by the casting unit 6 couples to one another all the units which influence the strip in the rolling mill 1 which is shown.

An open-loop and/or closed-loop control device 9 performs open-loop or closed-loop control of the operation of the unit 6, 2 or 8, in particular the operation of the mill train 2, and is enhanced by a machine-readable program code for carrying out the flying changeover of the discharge thickness. The machine-readable program code comprises control commands which, when executed, cause the open-loop and/or closed-loop control device 9 to carry out the method.

Before an embodiment of the method is applied, the mill train rolls a first discharge thickness H3 according to a first pass sequence. The rolling stock G-1 passes here with a thickness H0 into the mill train 2 or into the first rolling stand 3 of the mill train 2. The first rolling stand 3 rolls the rolling stock G-1 to a thickness H1. The rolling stock with the thickness H1 then passes into the second rolling stand 4 of the mill train 2 and is rolled thereby to a thickness H2. The rolling stock G-1 with the thickness H2 then passes into the third rolling stand 5 and is rolled thereby to a discharge thickness H3. A reduction in thickness of the first section G-1 of the rolling stock G according to the first pass sequence is shown directly underneath the schematically illustrated rolling mill 1.

Taking this thickness distribution for producing a first discharge thickness H3 as a starting point, rolling operation of the mill train 2 is performed—owing to a changed product requirement—from a rolling operation according to the first pass sequence to a rolling operation of the mill train 2 according to the second pass sequence during the rolling of rolling stock.

The customary calculation methods can be used for the calculation of pass sequences. Such a calculation method may be found, for example, in DE 37 21 744 A1.

In order to perform a transition of the discharge thickness H3 into a discharge thickness H3' from the mill train 2, a transition section X0 upstream of the first rolling stand is firstly determined. The transition section is a section of the rolling stock between the first and second sections G-1 and G-2 of the rolling stock G, which generally serves exclusively for the transition of the rolling operation of the mill train according to a first pass sequence to operation of the rolling train 2 according to the second pass sequence. To this extent, the start of a transition section is generally processed according to a first pass sequence and the end of the transition section according to a second pass sequence.

The transition section X0 is determined in particular in such a way that during the transition of the rolling operation according to a first pass sequence to the rolling operation according to the second pass sequence said transition section X0 has, at any point in time during the transition, a length which is not greater than the distance between two rolling stands. This ensures that the transition can be handled comparatively easily in terms of control technology because the transition section is not located simultaneously in two rolling stands at any time during the transition.

However, as an alternative it is possible to provide that, for example owing to technical plant restrictions, the thickness wedge will be rolled simultaneously in two or more adjacent rolling stands during the transition. This makes it possible to reduce the requirements made of the mill train with respect, for example, to the adjustment travel and acceleration for the respective rolling stands of the mill train.

Given such determination of the length of the transition section X0 upstream of the first rolling stand 3 of the mill train 2, in particular the number of rolling stands of the mill train 2 or the desired discharge thickness H3' from the mill train 2 according to the second pass sequence is to be taken into account.

If the second discharge thickness H3' which is rolled according to the second pass sequence is smaller than the first discharge thickness H3 which is rolled according to the first pass sequence, it is necessary to make a correspondingly short selection of the transition section X0. Since the latter is significantly lengthened by the mass flow, caused in the rolling stands, in the direction of transportation of the rolling stock G, it is possible in this way to ensure that the transition section X2 which is to be machined by the last rolling stand 5 of the mill train 2 has already exited from the rolling stand 4 which is arranged upstream of this rolling stand 5 in the direction of mass flow.

For a five-stand fabrication train, the length of the transition section X0 upstream of the first stand of the fabrication train is approximately 1 m for customary discharge thicknesses at the end of the mill train. This makes it possible to ensure that the length of the transition section between the fourth and fifth rolling stand is not longer than the distance between these rolling stands, which is, for example, approximately 4.70 m.

If a change occurs in the discharge thickness in the direction of larger discharge thicknesses, i.e. thicker strips, a correspondingly larger selection can also be made for the transition section X0 since the mass flow is correspondingly smaller in the direction of travel of the strip.

Lengthening the transition section X0 has the advantage that more time is available for the transition, as a result of which the changes for the actuating elements for the adaptation of the process variables become correspondingly smaller, and therefore the probability of the infringement of peripheral conditions which are predefined by the rolling mill 1 is reduced.

In the transition step S1, the transition of the operation of the first rolling stand 3 of the mill train 2 according to the first pass sequence to rolling operation according to the second pass sequence is illustrated. For this purpose, the chronological rolling force profile and the chronological profile of the circumferential speed of the working rollers, in particular during the transition from the rolling operation of the rolling stand 3 according to the first pass sequence to the rolling operation according to a second pass sequence are illustrated. For relatively short times in the illustration of the rolling force profile or the circumferential speed of the working rollers, the first rolling stand 3 is operated according to the first pass sequence, i.e. with the rolling force F1 and the working rolling circumferential speed V1. For relatively long times, the first rolling stand 3 is operated according to the second pass sequence, i.e. with the rolling force F1' and the working rolling circumferential speed V1'. Between these, the rolling force or the circumferential speed during the rolling of the transition section by the first rolling stand 3 experiences a change or transition from the rolling force F1 or the working rolling circumferential speed V1 according to the first pass sequence to the corresponding rolling force F1' and working rolling circumferential speed V1' according to the second pass sequence. The change takes place continuously and without jumps or jolts.

During the transition, the automatic gauge control, abbreviated AGC, is preferably switched off. This has the advantage of avoiding the risk of the AGC attempting to regulate the rolling gap at the first rolling stand 3 to the first pass sequence, and therefore counteracting the transition of the operation of the rolling stand 3 from the operation according to the first pass sequence to operation according to the second pass sequence.

The working rolling circumferential speed V1' at the first rolling stand 3 after the transition is generally dependent on the change in thickness which has taken place at the first rolling stand 3. In the case of the thickness reduction of H1' according to the first pass sequence to H1' according to the second pass sequence, said reduction occurring according to the exemplary embodiment, the circumferential speed of the working rollers of the rolling stand 3 is increased in order to keep the mass flow through the mill train 2 constant.

The difference ΔV1 between the circumferential speed V1 according to the first pass sequence and the circumferential speed V1' according to the second pass sequence is passed on to the rolling stands 4 and 5 which are arranged downstream of the first rolling stand 3, and the working rolling circumferential speeds of the rolling stands 4 and 5 which are arranged downstream of the first rolling stand 3 are made to follow the change in circumferential speed at the first rolling stand 3.

The working rollers of the second rolling stand 4 therefore have a working rolling circumferential speed of V2+ΔV1 while the transition section X1 is located between the first rolling stand 3 and the second rolling stand 4. Likewise, the third rolling stand 5 has a working rolling circumferential speed of V3+ΔV1 during the abovementioned time period. The rolling forces F2 and F3 for the rolling stands 4 and 5, respectively, are, however, kept essentially constant. As a result of the changing of the rolling operation of the first rolling stand 3 during the rolling of the transition section X0, a transition section X1 is produced which has a thickness profile, also referred to as thickness wedge. The latter is illustrated, for example, in the transition step S2 which shows the thickness profile of the rolling stock G after the first rolling stand has been changed from the rolling operation according to the first pass sequence to the rolling operation according to the second pass sequence.

Between the first rolling stand 3 and the second rolling stand there is therefore a thickness profile from a "new", relatively thin discharge thickness H1' to an "old", relatively thick discharge thickness H1. This thickness wedge is to be machined by the second or third rolling stand 4 or 5, respectively, arranged downstream of the first rolling stand 3 in the direction of mass flow.

Since there is therefore no thickness wedge caused by the transition of the rolling operation according to the first pass sequence to the rolling operation according to the second pass sequence for the first rolling stand 3, the first rolling stand 3 can be operated either exclusively with regulated position, SC, or exclusively with regulated rolling force FC. Operation of a rolling stand with regulated position is characterized by SC in FIG. 1, and operation of a rolling stand with regulated rolling force by FC. This operation with regulated position and operation with regulated rolling force are to be placed in relationship with the time axis of the rolling force profile and the circumferential speed profile of the working rollers in FIG. 1.

According to the transition step S1, the operation of the first rolling stand 3 is changed from operation with regulated position SC to operation with regulated rolling force FC just before the entry of the transition section X0. The changing from operation with regulated rolling force to operation with regulated position, and vice versa, takes place on the basis of the tracking of the strip by means of which the transition section is tracked. When the transition section X0 has passed the first rolling stand 3, the operation of the rolling stand 3 is changed again from operation with regulated rolling force to operation with regulated position SC. The above-mentioned changes for the subsequent rolling stands 4 and 5, respectively, take place similarly when the transition section X1 or X2, respectively, is processed by the latter.

In particular when the discharge thickness of the mill train is changed to relatively small thicknesses, strip tracking is too imprecise for rolling stands of the mill train with increasing proximity to the output of the mill train in order to be able to ensure correspondingly accurate operation of a rolling stand with regulated position SC. For this reason, it is necessary for these rolling stands to perform operation with regulated rolling force FC, since in this way automatic detection of the incoming thickness wedge or the transition section into the respective rolling stand is possible, either through an increase in the rolling force or a decrease in the rolling force.

According to S2, after the transition of the operation of the first rolling stand 3 from the operation according to a first pass sequence to operation according to a second pass sequence, rolling is now performed at the rolling stand 3 with the illustrated thickness distribution. A reduction in thickness from the rolling stock thickness H0 to a new rolling stock discharge thickness H1' from the first rolling stand 3 now occurs at said rolling stand 3.

In the transition step S2, the transition of the operation of the second rolling stand 4 of the mill train 2 according to the first pass sequence to rolling operation according to the second pass sequence is illustrated, with the first rolling stand being already operated in a steady-state fashion according to the second pass sequence. After the rolling of the transition section X0 by means of the first rolling stand 3, the latter is now present in the form of the transition section X1 downstream of the first rolling stand 3. During the passing of the transition section X1 through the second rolling stand 4, the latter is changed continuously from operation according to the first pass sequence to operation according to the second pass sequence.

Until the thickness wedge or the transition section X1 is fed into the second rolling stand 4, the rolling stand 4 must draw in the rolling stock thickness H1 on the inlet side and roll it to a discharge thickness H2 at the second rolling stand 4, but the working rollers of the second rolling stand 4 have a circumferential speed of V2+ΔV1 owing to the changed operation of the first rolling stand 3.

This can lead to overloading of the drive and/or to a reduction in the feed rate of the rolling stock G into the second rolling stand 4. If the feed rate is reduced, this affects the tension of the rolling stock since the feed rate at the second rolling stand and the discharge rate at the first rolling stand are no longer the same.

If undesired strip tension deviations occur, they are detected by the loop lifter 7, and intervention is carried out in the operation of the second rolling stand 4 on this basis, for example by correspondingly changing the rolling gap of the rolling stand 4 in such a way that the disruption of the desired strip tension or the overloading of a drive is compensated. Such interventions in the rolling gap of the rolling stand 4 can, if appropriate, be compensated again by the following rolling stand 5. The intervention is always carried out in such a way that it does not have a reaction on the feed rate of the rolling stock of the mill train 2.

The necessary loads or overloads of the drives are preferably taken into account in the calculation of the new pass sequence, with the result that they do not occur as scheduled in the transition of the operation of the mill train from operation according to the first pass sequence to operation according to the second pass sequence. However, in particular during the transition, checking is continuously carried out to determine whether technical plant restrictions are infringed in the transition of the operation of the mill train 2 or whether predefined threshold values for ensuring the operation of the plant are infringed.

During the transition of the second rolling stand 4 from operation according to the first pass sequence to operation according to the second pass sequence, the rolling force F2 is changed to a rolling force F2' during the rolling of the transition section. Associated with this there is generally also a change in the circumferential speed of the working rollers in the second rolling stand 4 from the rolling circumferential speed V2+ΔV1 to a rolling circumferential speed V2' according to the second pass sequence, which is formed essentially from the sums of V2, ΔV1 and ΔV2, where ΔV2 is that portion of the rolling circumferential speed V2' which is due to the changed discharge thickness H2' at the rolling stand 4. The rolling of the transition section X1 in the second rolling stand 4 takes place, as described above, with regulated rolling force FC. In the steady-state operation of the rolling stand 4 according to the respective pass sequence, operation of the rolling stand 4 with regulated position SC preferably occurs.

After the second rolling stand 4 has been passed through, the transition section X1 is changed to the transition section X2. Owing to the change which is performed in the rolling circumferential speed in the second rolling stand 4, the rolling circumferential speed of the working rollers in the third rolling stand 5 is to be correspondingly adapted to the discharge rate of the second section G-2 of the rolling stock G, which is then processed according to the second pass sequence.

In the transition step S4, the thickness profile of the rolling stock G is shown after the transition section X2 has exited the second rolling stand 4. There is then a thickness wedge between the second rolling stand 4 and the third rolling stand 5, wherein the thickness wedge has a thickness profile from a "new" discharge thickness H2', rolled according to the second pass sequence, to an "old" discharge thickness H2, rolled according to the first pass sequence.

The circumferential speed V3 of the working rollers of the third rolling stand 5 is adapted to the discharge rate of the rolling stock G out of the second rolling stand 4.

S5 shows the chronological rolling force profile and the profile of the working rolling circumferential speed for the respective rolling stands, while the transition section passes through the third rolling stand 5. During this time, the first and second rolling stands are already being operated in a steady-state operating mode according to the second pass sequence.

The transition section X2 or the thickness wedge has, before the last rolling stand 5 of the mill train 2, a length which is shorter than the distance between the last rolling stand and the penultimate rolling stand of the mill train; in the present exemplary embodiment these are therefore the second rolling stand 4 and the third rolling stand 5.

The transition of the operation of the third rolling stand 5 from operation according to the first pass sequence to operation according to the second pass sequence, i.e. the rolling of the transition section X2, takes place with operation of the third rolling stand 5 with regulated rolling force FC, in particular owing to the increased rolling stock speeds at the third rolling stand 5. In the steady-state operating mode of the rolling stand 5 according to the first or second pass sequence, said rolling stand 5 is operated with regulated position SC.

If the transition section X2 has completely passed through the third rolling stand, all the stands of the mill train are operated according to the second pass sequence. Steady-state operation of the mill train 2 according to the second pass sequence is then occurring. According to the transition step S6, the thickness distribution shown is present after the transition section X2 has passed through the third rolling stand 5. The "new" discharge thickness H3' then exits from the rolling stand 5 after having been rolled according to the second pass sequence. In addition, the thickness wedge can also be seen in the thickness distribution according to S6, said thickness wedge having a thickness profile from the thickness H3' to the thickness H3.

The transition from operation of the mill train according to the first pass sequence to operation of the mill train according to the second pass sequence during the rolling of rolling stock is terminated.

In the transition step S7, the chronological profiles of the rolling force or of the rolling circumferential speed for the respective rolling stands 3 to 5 are illustrated. The rolling stands 3 to 5 are now operated in a steady state, with regulated position according to the second pass sequence. The rolling forces at the respective rolling stands and the circumferential speeds of the working rollers of the rolling stands are essentially constant, within the scope of the AGC which is then switched on again.

The invention is not restricted to application to three-stand mill trains 2 but rather can be used particularly advantageously in the case of four-stand, five-stand, six-stand and seven-stand mill trains 2. The method can likewise be used in the batch operating mode, in the semi-endless operating mode or in the endless operating mode of a rolling plant or of a casting rolling plant.

The transition from a relatively thick discharge thickness to a thinner discharge thickness of the mill train is technically more demanding since the speeds become comparatively high toward the end of the mill train since the feed rate of the mill train is not available as a compensation variable for the high rolling speeds at the end of the mill train. In particular, in such transitions toward thinner discharge thicknesses from the mill train it is possible for overloading of individual drives on the respective rolling stands to occur and therefore for the strip tension to collapse completely under certain circumstances. This can lead to downtimes of the plant or damage to the plant which are to be, however, avoided as far as possible.

During the entire transition of the operation of the mill train according to the first pass sequence to operation of the mill train according to the second pass sequence, checking is continuously carried out to determine whether the transition of the mill train operation which is anticipated will infringe plant restrictions in order to avoid damage occurring to the mill train or to components of the mill train.

If the open-loop and/or closed-loop control device 9 determines such infringement or if the open-loop and/or closed-loop control device determines a high probability of plant restrictions being infringed within a short time, the transition from operation of the mill train according to the first pass sequence to operation according to a second pass sequence is interrupted, i.e. the planned transition is departed from so that the corresponding technical plant restrictions are not infringed.

This ensures that the rolling plant 1 is not damaged during the transition of the operation of the mill train 2 according to the first pass sequence to operation according to the second pass sequence.

In FIG. 1, the unit which is arranged upstream of the mill train 2 in the direction of mass flow is a casting unit 6. This casts with a casting speed V0 which is used as the feed rate into the mill train 2. The feed rate is therefore adapted to the casting speed V0 of the casting unit. In FIG. 1, the casting unit is embodied as an ingot mold. In a multi-stand fabrication train, a casting unit of the fabrication train is generally not arranged directly upstream in the direction of mass flow. However, in such a case it is nevertheless expedient to set the feed rate into the mill train as a function of the casting rate V0 in such a way that the casting rate is essentially without reaction of the feed rate of the rolling stock into the mill train. This is because the casting unit is only a small chronological dynamic with respect to regulating interventions. As a result of this inertia, the casting unit is frequently the limiting unit.

If the rolling stock then exits the mill train 2 with the discharge thickness H3', the thickness wedge is transported away in the direction of mass flow. The old discharge thickness H3 is then to be processed up to a certain point in time in the units, for example the cooling section 8 or a coiler (not illustrated in FIG. 1) located downstream of the mill train, and the transition section X3 is then to be processed, and then the new discharge thickness H3'. The resetting of a unit from the machining of rolling stock according to the first pass sequence to the machining of rolling stock according to the second pass sequence takes place during the influencing of the transition section X3 by the respective unit.

Since the cooling section 8 is generally longer than the transition section X3, while the transition section X3 passes through the cooling section 8 part of the cooling section is operated in such a way that it cools the first section G-1 of the rolling stock G as scheduled and that the latter also cools the second section G-2 as scheduled but in a changed way which is matched to the corresponding product. The resetting of the operation of the cooling section therefore always takes place for that section of the cooling section 8 which is actually influencing the transition section X3. As a result, the amount of rolling stock which is discarded continues to be kept small since the units which are also arranged downstream of the mill train 2 in the direction of mass flow are also reset from operation according to a first product sequence to operation according to a second product sequence, with the first pass sequence being assigned to the first product and the second pass sequence being assigned to the second product.

In one embodiment, during the transition of the operation of the mill train according to the first pass sequence to the operation of the mill train according to the second pass sequence, each rolling stand of the mill train is operated in such a way that each rolling stand brings about the same relative change in the thickness of the rolling stock. That is to say the relative change in thickness, for changing from the first discharge thickness of the mill train to the second discharge thickness of the mill train, is distributed uniformly over all the rolling stands of the mill train.

By way of example, the following table contains a first pass sequence and a second pass sequence as well as information about the relative change in thickness during the transition from operation of the mill train according to the first pass sequence to operation of the mill train according to the second pass sequence:

TABLE 1

| | Feed thickness [mm] | Relative reduction [%] | Discharge thickness [mm] | Rolling circum-ferential speed Vi [m/s] | Discharge thickness according to the second pass sequence/ Discharge thickness according to the first pass sequence | Rolling circum-ferential speed Vi according to the second pass sequence/ Rolling circum-ferential speed Vi according to the first pass sequence |
|---|---|---|---|---|---|---|
| First pass sequence | | | | | | |
| Rolling stand i = 1 | 15.00 | 40.00 | 9.00 | 1.67 | | |
| Rolling stand i = 2 | 9.00 | 40.00 | 5.40 | 2.78 | | |
| Rolling stand i = 3 | 5.40 | 25.00 | 4.05 | 3.70 | | |
| Rolling stand i = 4 | 4.05 | 10.00 | 3.65 | 4.12 | | |
| Second pass sequence | | | | | | |
| Rolling stand i = 1 | 15.00 | 50.00 | 7.50 | 2.00 | | |
| Rolling stand i = 2 | 7.50 | 40.00 | 4.50 | 3.33 | | |
| Rolling stand i = 3 | 4.50 | 25.00 | 3.38 | 4.44 | | |
| Rolling stand i = 4 | 3.38 | 10.00 | 3.04 | 4.94 | | |
| Rolling stand i = 1 | | | | | 0.83 | 1.20 |
| Rolling stand i = 2 | | | | | 0.83 | 1.20 |
| Rolling stand i = 3 | | | | | 0.83 | 1.20 |
| Rolling stand i = 4 | | | | | 0.83 | 1.20 |

Such a transition of operation of the mill train from operation according to a first pass sequence to operation of the mill train according to a second pass sequence, wherein the relative changes in thickness are kept constant at each rolling stand during the transition, ensures that a change in speed, in particular acceleration, of the entire train has to be carried out only at the respective first change in adjustment of the rolling stand which is brought about by the change in the pass sequence. That is to say the change in speed will occur at all the stands apart from at the stand at which the change in thickness is carried out, generally the rolling stand 1. As a result, a change in the discharge thickness of the rolling stock out of the mill train is implemented with small acceleration peaks and with, under certain circumstances, a constant mass flow through the mill train, as a result of which, for example, the operation of a casting unit which is arranged upstream of the mill train in the direction of mass flow is not influenced by the changeover of the discharge thickness in the mill train.

Figure 2:
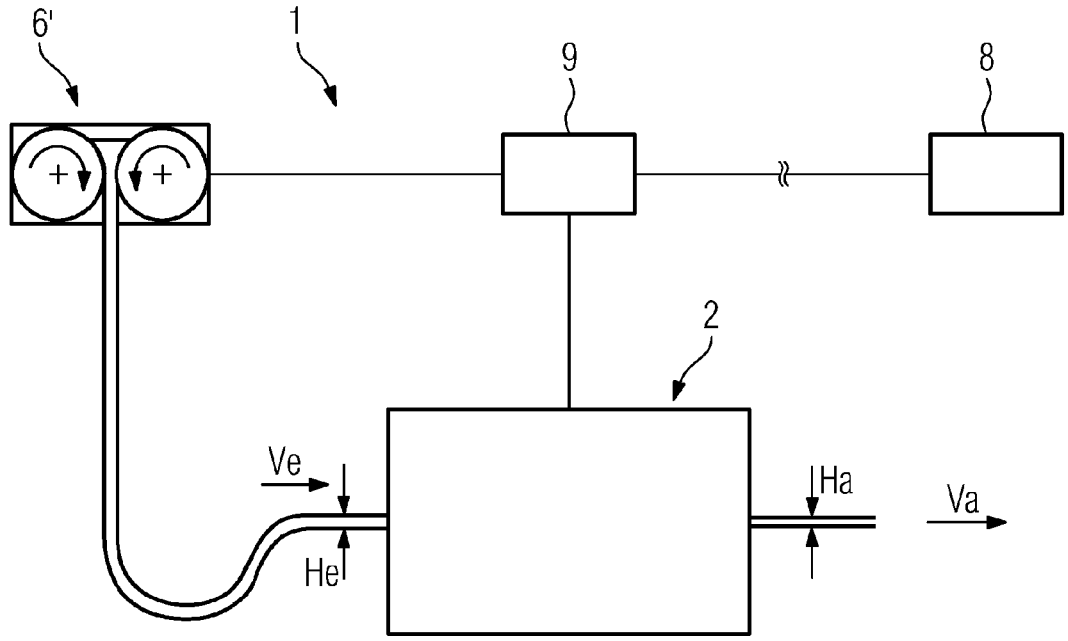
FIG. 2 shows a schematically illustrated plant for carrying out an embodiment of the method, wherein a unit which casts metal is embodied as a two roller casting machine.

FIG. 2 shows a further possible way according to an embodiment for the rolling mill 1 comprising a two-roller casting machine 6', wherein, the cast rolling stock G subsequently passes through a multi-stand, i.e. an at least two-stand, mill train 2.

Rolling stock G is generally produced in an endless operation by means of a two-roller casting machine 6'. In this type of plant it is advantageous that it is even more compact than an endless-operation plant which casts by means of ingot molds 6, cf. FIG. 1. In addition, the consumption of energy and resources is reduced further.

The compactness and the reduced use of resources results from the fact that a two-roller casting machine makes it possible to cast more closely to the final dimensions of the desired end product. That is to say the rolling stock which exits from the rolling casting machine is generally already significantly thinner than the rolling stock which exits from an ingot mold. As a result it is possible, for example, for a roughing mill or high reduction mill, which is generally arranged downstream of an ingot-mold-operated casting machine, to be dispensed with. This generally has the purpose of preparing rolling stock cast from the ingot mold for final rolling in a shaping fashion. This is generally not necessary when a two-roller casting machine is used. Instead, all that is necessary is for the rolling stock to be finally rolled with the mill train 2. In this case is may also be desired for a discontinued product which is discharged from the plant to be changed, for example owing to customer requirements or changes in priority. An embodiment of the method can advantageously be used for this purpose.

In order to reset the discharge product from a first discharge thickness to a second discharge thickness by means of a mill train 2 which is arranged downstream of the two-roller casting machine 6', the operation of the mill train 2 can be reset during ongoing operation in accordance with the statements relating to FIG. 1 in such a way that this objective is achieved. Statements relating to FIG. 1 apply analogously to FIG. 2.

What is claimed is:

1. A method for adjusting a discharge thickness of rolling stock which passes through a multi-stand mill train of a plant, the multi-stand mill having a plurality of roll stands, the method comprising:

executing a predetermined first pass sequence, including:

setting the plurality of roll stands of the mill train to set a first discharge thickness; and rolling a first section of the rolling stock to the first discharge thickness, while continuing to roll the rolling stock, executing a transition from the predetermined first pass sequence to a predetermined second pass sequence, including:

adjusting one or more of the plurality of roll stands of the mill train to transition from the first discharge thickness to a second discharge thickness different from the first discharge thickness;

wherein the adjusting of each respective roll stand is performed during the rolling of a defined transition section of the rolling stock by the respective rolling stand;

regulating a rolling force for at least one of the rolling stands during the rolling of the respective transition section; and throughout the transition, automatically adjusting a feed rate of the rolling stock into the mill train to actively compensate for any changes in a discharge rate of the rolling stock from a unit which is arranged upstream of the mill train in the direction of mass flow; and after completing the transition, executing the predetermined second pass sequence, including rolling a second section of the rolling stock to the second discharge thickness, and during the rolling of the transition section, automatically checking compliance with technical plant restrictions, and if the restrictions are infringed or are expected to be infringed, automatically interrupting the transition from the operation of the mill train according to the first pass sequence to the operation of the mill train according to the second pass sequence, wherein the technical plant restrictions comprise predefined technical restrictions that allow production of a desired product according to an operational schedule of the plant.

2. The method according to claim 1, wherein the feed rate is adjusted essentially to the discharge rate of a subsequent unit which is arranged upstream of the mill train.

3. The method according to claim 1, wherein the mill train and at least one unit which is arranged upstream of the mill train in the direction of mass flow are coupled in terms of fabrication technology by the rolling stock having the first and the second rolling stock sections.

4. The method according to claim 1, wherein the transition section is determined in such a way that at every point in time during its passage through the mill train it has a length which is at maximum equal to a distance between two adjacent rolling stands.

5. The method according to claim 1, wherein during the rolling of the transition section, an actual process variable which is adjusted on the basis of the first pass sequence is continuously changed into a setpoint process variable which is determined on the basis of the second pass sequence.

6. The method according to claim 1, wherein at least one of the rolling force and the rolling gap of a rolling stand which is to be passed through next by the transition section is adjusted, in addition to the first and second pass sequences, as a function of the strip tension between this rolling stand and the rolling stand which is arranged upstream of this rolling stand in the direction of mass flow.

7. The method according to claim 1, wherein during the transition from the operation of the mill train according to the first pass sequence to the operation of the mill train according to the second pass sequence, each rolling stand of the mill train is operated in such a way that the relative change from the first discharge thickness to the second discharge thickness for each rolling stand of the mill train is essentially constant.

8. The method according to claim 1, wherein, after the transition from the operation of the mill train according to the first pass sequence to operation of the mill train according to the second pass sequence, drive loads of rolling stand drives which are assigned to the mill train are redistributed during the rolling of the second discharge thickness.

9. The method according to claim 1, wherein a change, necessary due to the changed discharge thickness of the mill train, in manipulated variables for at least one unit which is arranged downstream of the mill train in the direction of mass flow takes place while the transition section is being influenced by this at least one unit.

10. The method according to claim 1, wherein the unit upstream of the mill train is a casting unit.

11. A rolling mill comprising:

a multi-stand mill train for rolling metallic rolling stock, comprising:

a plurality of roll stands;

an open-loop and/or closed-loop control device comprising instructions stored in non-transitory computer readable media and executable by a processor to:

(a) execute a predetermined first pass sequence, including:

setting the plurality of roll stands of the mill train to set a first discharge thickness; and rolling a first section of the rolling stock to the first discharge thickness, (b) while continuing to roll the rolling stock, execute a transition from the predetermined first pass sequence to a predetermined second pass sequence, including:

adjusting one or more of the plurality of roll stands of the mill train to transition from the first discharge thickness to a second discharge thickness different from the first discharge thickness;

wherein the adjusting of each respective roll stand is performed during the rolling of a defined transition section of the rolling stock by the respective rolling stand;

regulating a rolling force for at least one of the rolling stands during the rolling of the respective transition section; and throughout the transition, adjust a feed rate of the rolling stock into the mill train as a function of a discharge rate of the rolling stock from a unit which is arranged upstream of the mill train in the direction of mass flow, such that the discharge rate of the rolling stock from the unit upstream of the mill train is not affected by the transition from the first discharge thickness to the second discharge thickness; and throughout the transition, automatically adjust a feed rate of the rolling stock into the mill train to actively compensate for any chances in a discharge rate of the rolling stock from a unit which is arranged upstream of the mill train in the direction of mass flow; and (c) after completing the transition, execute the predetermined second pass sequence, including rolling a second section of the rolling stock to the second discharge thickness, and during the rolling of the transition section, automatically check compliance with technical plant restrictions, and if the restrictions are infringed or are expected to be infringed, automatically interrupt the transition from the operation of the mill train according to the first pass sequence to the operation of the mill train according to the second pass sequence, wherein the technical plant restrictions comprise predefined technical restrictions that allow production of a desired product according to an operational schedule of the plant.

12. The rolling mill according to claim 11, wherein the feed rate is adjusted essentially to the discharge rate of a subsequent unit which is arranged upstream of the mill train.

13. The rolling mill according to claim 11, wherein the mill train and at least one unit which is arranged upstream of the mill train in the direction of mass flow are coupled in terms of fabrication technology by the rolling stock having the first and the second rolling stock sections.

14. The rolling mill according to claim 11, wherein the transition section is determined in such a way that at every point in time during its passage through the mill train it has a length which is at maximum equal to a distance between two adjacent rolling stands.

* * * * *